US005826815A

United States Patent [19]

Hermanns et al.

[11] Patent Number: 5,826,815

[45] Date of Patent: Oct. 27, 1998

[54] METHOD AND APPARATUS FOR DETERMINING A VALUE OF SLIPPAGE IN THE WINDING OF A YARN PACKAGE

[75] Inventors: Ferdinand Hermanns, Erkelenz; Andreas Krüger, Mönchengladbach, both of Germany; Urs Meyer, Zürich, Switzerland

[73] Assignee: W. Schlafhorst AG & Co., Monchen-Gladbach, Germany

[21] Appl. No.: 882,797

[22] Filed: Jun. 26, 1997

[30] Foreign Application Priority Data

Jun. 26, 1996 [DE] Germany ..... 196 25 510.4

[51] Int. Cl.[6] ..... B65H 54/38; B65H 54/40

[52] U.S. Cl. ..... 242/477.8; 242/485.7; 242/486.7

[58] Field of Search ..... 242/477.8, 485.7, 242/486.7

[56] References Cited

FOREIGN PATENT DOCUMENTS 29 14 924 A1 10/1980 Germany .
32 42 318 A1 6/1983 Germany .
37 03 869 A1 8/1988 Germany .

*Primary Examiner*—Michael Mansen
*Attorney, Agent, or Firm*—Kennedy Covington Lobdell & Hickman, LLP

[57] ABSTRACT

A yarn package (both conical and cylindrical) is produced at a winding station of a textile winding machine by alternately: accelerating the friction roller driving the yarn package with slippage between the friction roller and the entire surface of the yarn package; and decelerating the friction roller driving the yarn package without slippage between the friction roller and at least part of the surface of the yarn package, e.g., the neutral zone of a conical package. The periods (and thus the frequencies and angular velocities) of the friction roller and the yarn package are detected by sensors which communicate the detected values to a control and evaluation device. Based on the detected values during at least one phase of deceleration, the control and evaluation device estimates the yarn package radius during an acceleration phase. Additionally, based on detected values during the acceleration phase, and based on the known radius of the friction roller, the control and evaluation device calculates a distorted radius of the yarn package and compares the estimated radius with the distorted radius to determine a value of slippage that occurs during the acceleration phase. The winding process is then adjusted if standard values of slippage indicative of a quality yarn package are not achieved.

11 Claims, 3 Drawing Sheets

METHOD AND APPARATUS FOR DETERMINING A VALUE OF SLIPPAGE IN THE WINDING OF A YARN PACKAGE

FIELD OF THE PRESENT INVENTION

The present invention relates to a textile machine for winding yarn packages that includes a friction roller for driving each yarn package and a drive motor for driving the friction roller and, in particular, to a winding machine having a drive motor that accelerates and decelerates the friction roller at intervals whereby acceleration phases with slippage between the friction roller and the yarn package and deceleration phases free of slippage alternately occur.

BACKGROUND OF THE PRESENT INVENTION

In German Patent Publication DE 37 03 869 A1, a textile machine for winding yarn packages is disclosed which includes a drive motor for driving a friction roller alternately between: acceleration phases with slippage between the friction roller and the yarn package; and deceleration phases free of slippage therebetween. Furthermore, in the process the period of the friction roller and the period of the bobbin of the yarn package are continuously measured, and an evaluation is performed whereby, in phases which are at least approximately free of slippage, a comparison value is formed from the result of the measurements (in particular a quotient) which is compared with a set value, and a modification in the winding parameters is made if considerable deviations from the set value occur. Since the quotients sequentially formed in phases free of slippage are approximately constant, a comparison of sequentially formed quotients is also made to determine whether a phase with slippage or a phase without slippage is present. However, the size of the slippage occurring in a phase is not quantified.

The switching between acceleration phases with slippage and deceleration phases free of slippage is performed to generate interference with yarn patterns that otherwise would form in the yarn packages in the random winding process. Nevertheless, it would be advantageous for effective pattern interference not only to determine whether slippage was in fact generated, as in German Patent Publication DE 37 03 869 A1, but also to quantify the amount of the slippage.

OBJECT AND SUMMARY OF THE PRESENT INVENTION

It is therefore an object of the present invention to quantify the amount of slippage occurring in the acceleration phase during winding without the use of sensors other than those sensors that detect the period of the friction roller and the period of the yarn package. Furthermore, because frequency is defined as the reciprocal of the period and because angular velocity equals the product of the frequency and $2\pi$, it is to be understood that the sensors that detect the periods of the friction roller and yarn package thereby also detect the frequencies and angular velocities thereof The object of quantifying the slippage in an acceleration phase is attained in the present invention by comparing an estimated value of the radius of the yarn package with a value calculated from the periods detected by the sensors which calculated value is distorted due to slippage. In particular, because of the slippage in an acceleration phase, a difference results between the circumferential speed of the friction roller and the circumferential speed of the yarn package and, if the increase in the radius of the yarn package is calculated from the determined periods of the fiction roller and the yarn package, a value results that is distorted by the slippage and that is greater than the actual radius which can be estimated. As a result, a magnitude of the slippage can be quantitatively determined from the difference between this distorted value and the estimated value without the presence of any additional sensors.

Thus, the method of the present invention includes the steps of: (1) alternately accelerating and decelerating a friction roller that drives a yarn package being wound so that slippage occurs between the friction roller and the entire surface of the yarn package during each phase of acceleration and so that no slippage occurs between the friction roller and part of the surface of the yarn package during each phase of deceleration; (2) detecting a value representative of the angular velocity of the friction roller and detecting a value representative of the angular velocity of the yarn package at least once during each acceleration phase and each deceleration phase; (3) estimating a yarn package radius for a certain point in the winding process from a mathematical progression based upon values detected in a deceleration phase; (4) calculating a distorted yarn package radius based upon the fixed radius of the friction roller and based upon values of the friction roller and the yarn package detected at the certain point in the winding process; and (5) comparing the estimated yarn package radius with the calculated distorted yarn package radius to determine a value of slippage.

In a further feature of the present invention the values of the slippage occurring in the course of the yarn package winding are stored and can be shown on a display. It is known to judge the quality of a yarn package by an unwinding test in which the yarn is drawn off If the draw-off encounters difficulties and, in particular, results in a yarn break, then unsuccessful pattern interference was likely performed during the winding operation because of an unsuitable slippage. As a result of the present invention, the user in such an instance has the opportunity to display the course of the slippage that occurred during the winding operation and adjust the operating parameters of the winding device in such a way that improved pattern interference and, therefore, improved draw-off properties, are achieved by modifying the slippage. Furthermore, by storing the values of the slippage occurring in the course of the yarn package winding at a particular winding machine, it is possible to compare the course of the slippage during that winding operation with the course of the slippage during a winding operation at another winding machine to detect a malfunction of a winding machine.

In a further feature of the present invention the actual values of the slippage detected during winding are compared with set values, and if a sufficient deviation of the actual values from the set values are detected, one or more operating parameters of the winding device are changed in order to adjust the actual values toward the set values. It is therefore possible, for example, to set the magnitude of the acceleration by trial and error so that sufficient slippage is created but too much slippage is avoided. Not only is the quality of the yarn package improved thereby from the resulting effective pattern disruption, but the energy consumption of the winding device is additionally optimized.

In yet a further feature of the present invention, in the course of start-up following an interruption of the winding process the actual values of the slippage are determined and compared with predetermined set values and, when the actual values sufficiently surpass the set values, an intervention in a start-up control of the drive motor takes place in order to limit slippage to the set values. Such interruptions occur relatively often in connection with winding devices of yarn package winding machines, such as when a yarn fault is cleaned up and a draw-off bobbin (spinning cop) is used up and is replaced by a fresh one. It is therefore advantageous, particularly in connection with such yarn package winding machines, that the start-up following an interruption is performed as quickly as possible without damage to the yarn layers from excessive slippage.

The apparatus of the present invention includes a winding device of a textile machine having a friction roller that controls the winding of yarn onto a yarn package and a drive motor for controlling acceleration and deceleration of the friction roller. The controlled acceleration of the friction roller results in slippage between the friction roller and the complete surface of a yarn package being wound, and the controlled deceleration results in no slippage between the friction roller and at least part of the surface of the yarn package. The apparatus also includes a first sensor that detects the period of the yarn package and a second sensor that detects the period of the friction roller. A control and evaluation device is also provided in communication with the sensors and includes: a quotient former that calculates a ratio between the angular velocities of the friction roller and the yarn package based upon detected periods of the yarn package and the friction roller; a linear filter that evaluates a progression of the yarn package radius in at least one deceleration phase for estimating the yarn package radius in an acceleration phase based upon the calculated ratio and the detected angular velocities in the deceleration phase; and a subtraction device for comparing the estimated yarn package radius in the acceleration phase with the calculated yarn package radius in the acceleration phase to determine a value of slippage.

Preferably, when a cylindrical bobbin is used in the present invention, the friction roller drives the yarn package free from slippage during the deceleration phases. When a conical bobbin is used, the so-called "driven diameter" progresses in the axial direction on the yarn package surface from the largest yarn package diameter toward the smallest yarn package diameter during the deceleration phase, where the driven diameter is defined as the diameter of the yarn package at which the circumferential speed thereof matches the circumferential speed of the friction roller. In referencing a yarn package radius or a yarn package diameter herein, the driven diameter, also sometimes referred to as the neutral diameter, is meant in connection with a conical yarn package, and slippage between the friction roller and yarn package is to be understood as slippage between the friction roller and the entire surface of the conical yarn package, i.e., when the driven diameter ceases to exist.

BRIEF DESCRIPTION OF THE DRAWINGS

Further characteristics and advantages of the present invention will follow from the following description of the embodiments represented in the drawings, wherein.

DETAILED DESCRIPTION OF THE PREFERRED EMBODIMENTS

Figure 1:
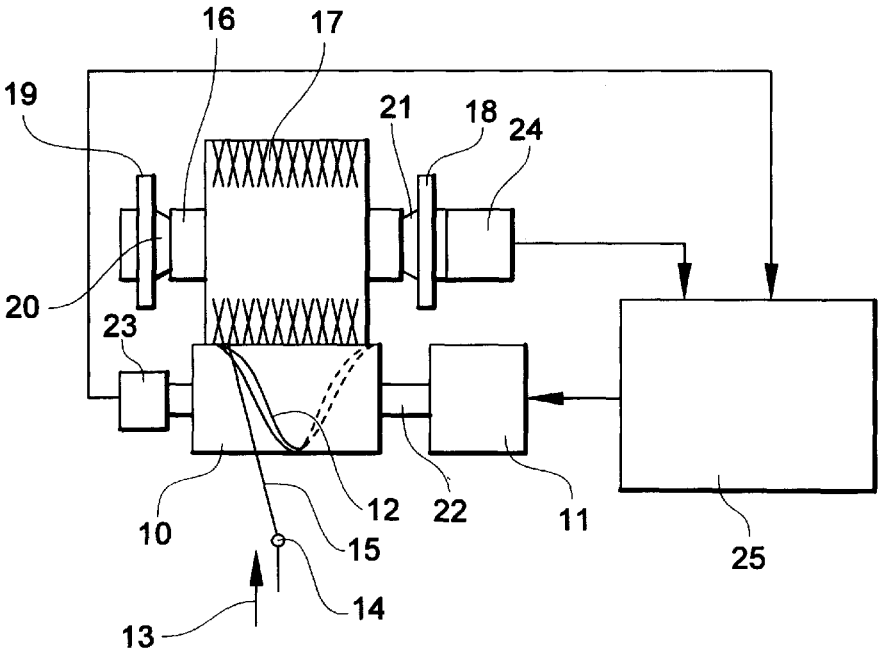
FIG. 1 is a schematic view of a textile machine for winding yarn packages including a control and evaluation device of the present invention.
Figure 2:
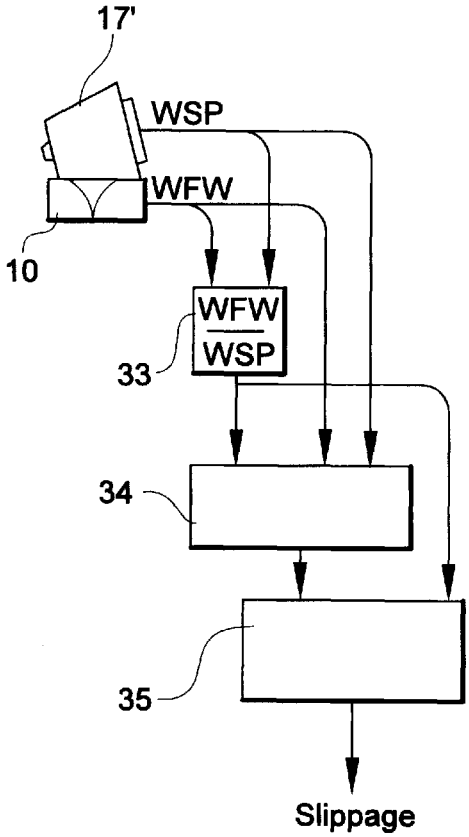
FIG. 2 is a block diagram of the control and evaluation device of the present invention.

The textile machine for winding yarn packages and, in particular, the winding device of a winding station is shown schematically in FIG. 1 and includes a friction roller 10 that is driven by a drive motor 11. The friction roller 10 is embodied as a so-called cam cylinder, which is provided with a reversing groove 12 whereby it is used simultaneously as a traversing device for a yarn 15 fed in direction 13 through a yarn guide 14. The yarn 15 is wound via random windings on a bobbin core 16 to form a yarn package 17. Since the present invention is suitable for producing cylindrical yarn packages as well as conical yarn packages, a cylindrical yarn package 17 is shown in FIG. 1 and a conical yarn package 17' is shown in FIG. 2.

In FIG. 1, the bobbin core 16 is frictionally supported by cones 20,21 of two bobbin boards 18,19 that respectively enter the open ends of the bobbin core 16. The bobbin boards 18,19 which rotate with the bobbin core 16 and therefore also with the yarn package 17 and are seated in a winding frame (not shown) that is pivotable around an axis parallel to shaft 22 of the friction roller 10.

A sensor 23, which for example is embodied as an angle of rotation sensor, is disposed adjacent the shaft 22 of the friction roller 10 and detects the period (and therefore the angular velocity) of the friction roller 10, where the period is understood to be the time of a complete revolution. Another sensor 24 is disposed adjacent the bobbin board 18, which for example is also embodied as an angle of rotation sensor, and also detects the period (and therefore the angular velocity) of the yarn package 17. Signals representing the detected periods are sent from the sensors 23,24 to a control and evaluation device 25, described in greater detail below.

In order to prevent patterns when producing the yarn packages 17 by random winding, so-called pattern interference is performed wherein slippage is intermittently generated between the friction roller 10 and the yarn package 17. Specifically, when the angular velocity of the friction roller 11 falls below a predetermined value following the switching off of the drive motor 11, the drive motor 11 is switched on again whereby the friction roller 10 is accelerated to a maximum angular velocity; thereafter the drive motor 11 is switched off again and the cycle is repeated. Because of the mass moment of inertia of the yarn package 17 and the magnitude of the acceleration, a slippage between the friction roller 10 and the yarn package 17 is generated in the course of acceleration of the friction roller 10 during each cycle.

Starting with the initially empty bobbin core 16 resting on the friction roller 10, the radius or diameter of the yarn package 17 increases because of the yarn wound on it until the yarn package 17 has reached is maximum degree of filling, i.e., its maximum radius or diameter.

A yarn package radius can be calculated, based on the measurements detected by the sensors 23,24 in accordance with the following equation:

$$\omega_{yp} \times r_{yp} = \omega_{fr} \times r_{fr} \quad \text{(Eq.\#1)}$$

and from this:

$$r_{yp} = \frac{\omega_{fr} \times r_{fr}}{\omega_{yp}} \quad \text{(Eq. \#2)}$$

where:

$r_{yp}$=radius of the yarn package;

$r_{fr}$=radius of the friction roller;

$\omega_{yp}$=angular velocity of the yarn package; and $\omega_{fr}$=angular velocity of the friction roller.

Figure 3:
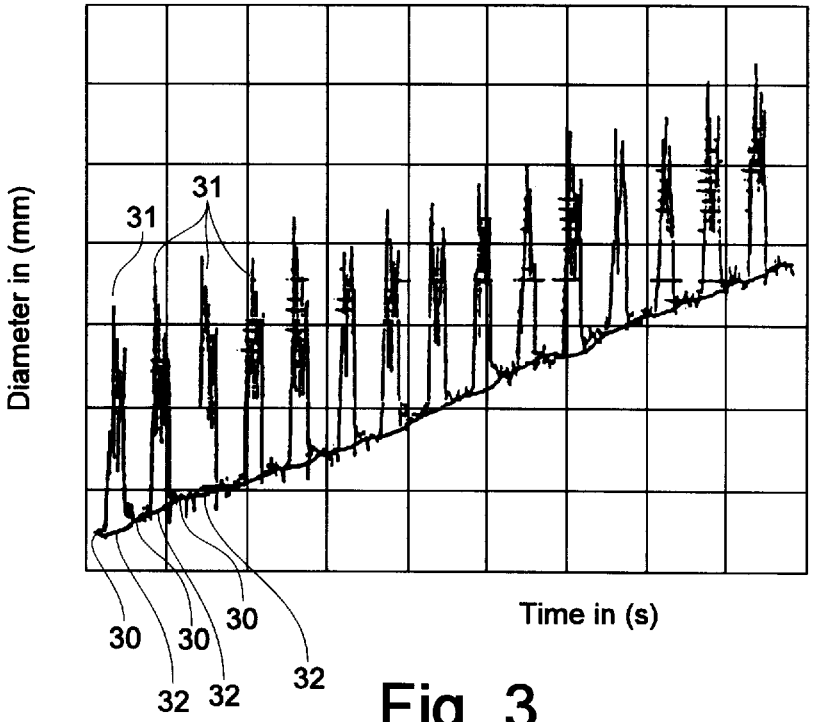
FIG. 3 is a graph which illustrates the change in the yarn package diameter over time for a yarn package being wound in accordance with the present invention.

If the calculation of Eq. #2 is continuously performed at short intervals, for example at intervals of 0.1 seconds, a curve results as shown in FIG. 3 illustrating over time the diameter, i.e., twice the yarn package radius.

In particular, FIG. 3 shows a diameter increase of approximately 0.6 mm in the range of a yarn package diameter of approximately 129.3 mm to approximately 129.9 mm during a period of time of approximately 18 seconds. The lower sections 30 of this curve correspond to the deceleration phases in which the drive motor 11 of the friction roller 10 is switched off and the friction roller 10 drives the cylindrical yarn package 17 free of slippage. Because there is no slippage during the lower sections 30 corresponding to the deceleration phases, the circumferential velocity of the friction roller 10 equals the circumferential velocity of the yarn package 17, and Eq. #1 and Eq. #2 therefore accurately describe the yarn package radius in the lower sections 30. Furthermore, the actual yarn package diameter during an acceleration phase, i.e., in one of sections 31, can be estimated by interpolation or extrapolation of the curve represented in one or more of the lower sections 30.

In the acceleration phases represented by sections 31 between the lower sections 30, the yarn package 17 slips with respect to the friction roller 10 and therefore Eq. #1 and Eq. #2 do not accurately describe the actual winding process. Nevertheless, taking into consideration that the periods of the friction roller 10 and the yarn package 17 are detected by sensors 24,25, and that the radius of the friction roller 10 is fixed, a value can be calculated by Eq. #2 which will be greater than the actual radius. Thus, Eq. #2 results in a "distorted" yarn package radius, i.e., a radius that is distorted from the actual value due to the slippage between the friction roller 10 and the yarn package 17. The slippage can be quantified based upon the estimated yarn package radius and the calculated distorted radius, as now detailed. First, the following describes the slippage S:

$$v_{yp}=(1\times S)\cdot V_{fr} \quad \text{(Eq. \#3)}$$

where:

$v_{yp}$=the circumferential velocity of the yarn package; and $v_{fr}$=the circumferential velocity of the friction roller.

Equation #3 states that the circumferential velocity of the yarn package 17 is less than the circumferential velocity of the friction roller 10 by a certain percentage slippage S. Since the circumferential velocity of the yarn package 17 equals the angular velocity times the radius of the yarn package 17, Eq. #3 becomes:

$$\omega_{yp}\times r_{yp}(1-S)\times v_{fr} \quad \text{(Eq. \#4)}$$

and thus:

$$S = 1 - \frac{\omega_{yp} \times r_{yp}}{v_{fr}} \quad \text{(Eq. \#5)}$$

and:

$$S = \frac{v_{fr} - (\omega_{yp} \times r_{yp})}{v_{fr}} \quad \text{(Eq. \#6)}$$

With $v_{fr}=\omega_{yp|s=0}\bullet r_{yp}$, where $\omega_{yp|s=0}$ is the angular velocity of the yarn package 17 when there is no slippage, the following results:

$$S = \frac{(\omega_{yp}|_{s=0} \times r_{yp}) - (\omega_{yp} \times r_{yp})}{\omega_{yp}|_{s=0} \times r_{yp}} \quad \text{(Eq. \#7)}$$

and thus:

$$S = 1 - \frac{\omega_{yp}}{\omega_{yp}|_{s=0}} \quad \text{(Eq. \#8)}$$

The yarn package radius is calculated in the acceleration phases as the so-called distorted radius from:

$$r_{yp}|_{r\ distorted} = r_{yp} \times \frac{\omega_{yp}|_{s=0}}{\omega_{yp}} \quad \text{(Eq. \#9)}$$

The following equation therefore results for the slippage between the friction roller and the yarn package:

$$S = \frac{r_{yp}|_{r\ distorted} - r_{yp}}{r_{yp}|_{r\ distorted}} \quad \text{(Eq. \#10)}$$

Figure 4:
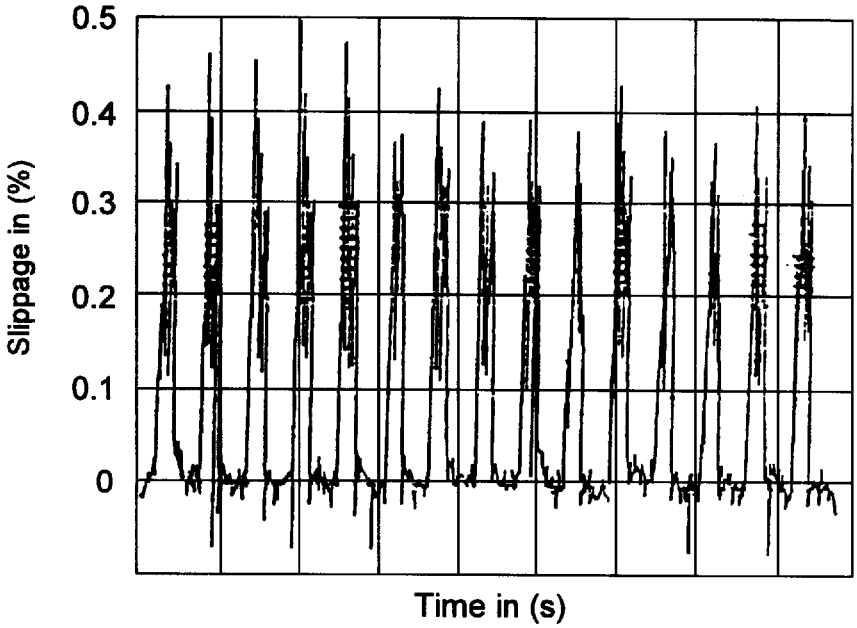
FIG. 4 is a graph which illustrates the slippage occurring between a friction roller and the yarn package in FIG. 3, wherein the slippage is normalized to the diameter of the yarn package.

Taking into consideration the increase of the yarn package radius or diameter calculated from measurements taken in one or several deceleration phases 30, a mathematical progression representing the increase of the yarn package radius or diameter for an acceleration phase can be evaluated in the form of a compensating line 32 shown in FIG. 3. The difference between the distorted yarn package radius and the estimated radius normalized to the distorted radius thus represents a measure of the slippage which occurs in the acceleration phases 31. This slippage (in percent) is shown versus time in FIG. 4.

Figure 5:
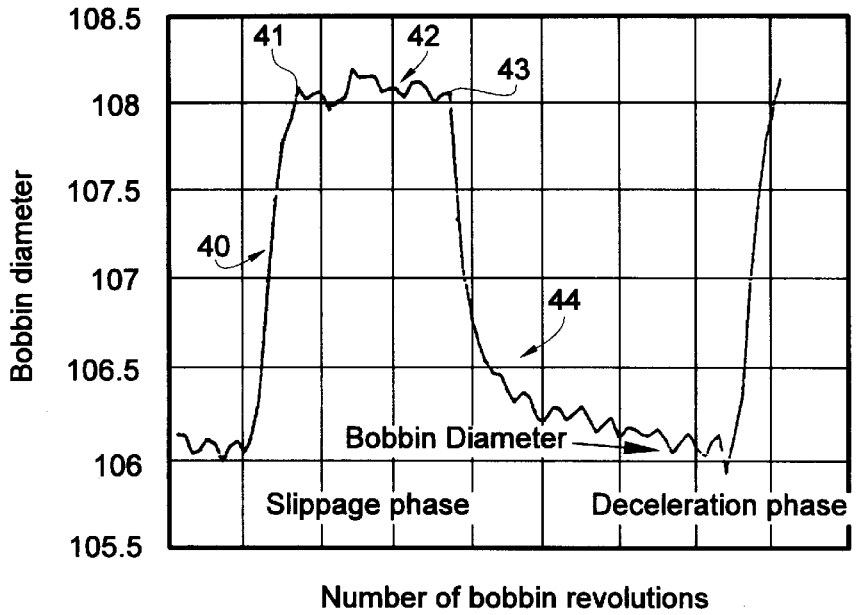
FIG. 5 is a graph which illustrates change in a yarn package diameter during an acceleration phase and a deceleration phase, wherein the yarn package includes a conical bobbin.

With regard to conical yarn packages, as can be seen in FIG. 5, the driven diameter of a conical yarn package 17' changes during acceleration. In FIG. 5 the yarn package 17' is accelerated in section 40 until the driven diameter progresses past the larger diameter edge at point 41, i.e., until the driven diameter disappears and the yarn package 17' is driven exclusively with positive slippage between the yarn package 17' and the friction roller 10. Starting at this point 41, a drive with slippage occurs in the present invention. Moreover, the yarn package diameter calculated during the acceleration phase 40 is distorted and the yarn package diameter calculated during the phase with slippage in section 42 is fictitious. After shutting off the acceleration of the friction roller 10, the fictitious yarn package diameter reaches that of the yarn package 17' being driven without slippage at the point 43, and a real, driven diameter progresses, proportionally with the decreasing angular velocity of the friction roller 10, on the yarn package 17' from the large diameter toward the smaller diameter during the so-called deceleration phase of section 44. Because of the acceleration-free drive, the driven diameter reaches the so-called neutral diameter zone toward the end of the deceleration phase of section 44, whereat respectively one diameter of the conical yarn package 17' can be defined.

Reaching the neutral zone depends on several influencing factors, for example the fulling effect, the conicity of the yarn package and the friction between the friction roller and the yarn package, which has an interfering effect on the determination of the diameter thereof The curve path shows a lateral entry or swing-in process, i.e., oscillation of the yarn package diameter. The swing-in process cannot be used for determining the diameter of the yarn package because the distorted diameter does not agree with the neutral cone diameter, defined as the yarn package diameter. Nevertheless, since an actual yarn package diameter must be available for the next acceleration phase, the swing-in process can be equalized. This is accomplished by entering the data of previous entries of the diameter into the neutral zone. Presuming that the above mentioned interference factors do not change during an interference cycle, it can be assumed that the previous interference cycles have a similar entry as the current one. Hence, it is possible to set up a model progression for estimating the entry process, whereby once the model progression has been determined, it will be possible to forecast the neutral cone diameter for every moment of the entry phase.

The calculation of a compensation polynomial of the n-th degree presents itself as the preferred model process. If the model parameters (polynomial coefficients) of the last n entry cycles have been calculated, a model entry phase can be determined simultaneously with the actual entry phase. To this end it is necessary to average the n parameter sets of the entry cycles and a simultaneous progression must be developed. If the measured distorted diameter value is divided by the corresponding model diameter value, an equalized diameter progression is obtained. This progression is corrected by the amount of the actually applicable cone diameter.

Figure 6:
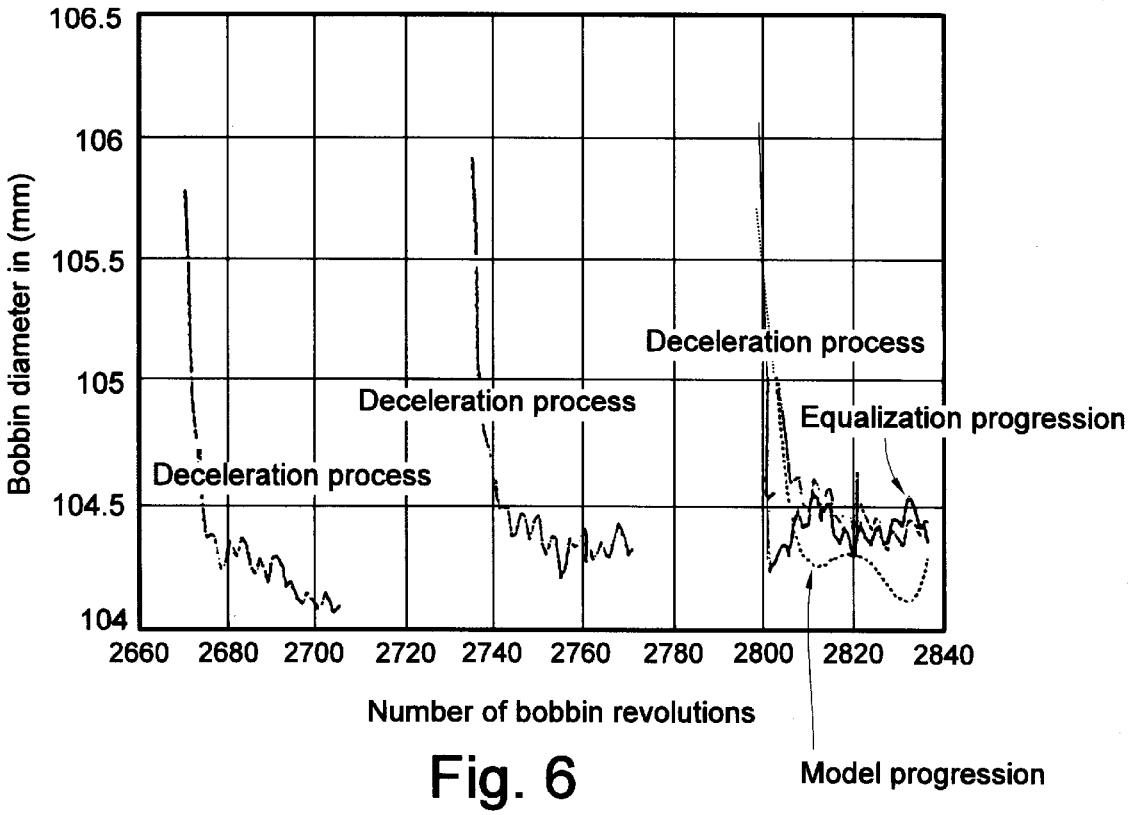
FIG. 6 is a graph which graphically illustrates an equalized deceleration progression of the diameter of a yarn package that includes a conical bobbin.

The inclusion of several deceleration cycles in the model deceleration cycle is recommended, since it must be assumed that occurring differences of various deceleration cycles can thereby be averaged. This method is shown in FIG. 6. A model deceleration for the deceleration n is calculated based on the decelerations n-2 and n-1 and is simultaneously carried. At the same time the detected distorted diameter is divided by the distorted model diameter, which results in an equalized diameter progression in the deceleration phase.

With regard to the conical and cylindrical bobbins, both the calculation of the compensation line 32 and the slippage S can be performed in accordance with an evaluation device 25 shown in FIG. 1 and detailed in FIG. 2. The periods of the yarn package and of the friction roller detected by the sensors 23,24, and thereby the angular frequencies $\omega_{fr}$ and $\omega_{yp}$, are entered into a quotient former 33. Since the radius $r_{fr}$ of the friction roller 10 is constant, the quotient $\omega_{fr}$ to $\omega_{yp}$ calculated by the quotient former 33 is representative of the yarn package radius $r_{yp}$, and the multiplication with the radius $r_{fr}$ of the friction roller 10 can be omitted. The quotient is then entered in a linear filter 34, for example a Kalman filter, into which the angular velocity $\omega_{yp}$ of the yarn package and the angular velocity $\omega_{fr}$ of the friction roller 10 are also entered, and the linear filter 34 forms the compensation line 32. In connection with conical filters diameter values in the deceleration phases only are made available to the filter.

Determination of the compensation line 32 based upon detected periods only occurs in the slippage-free phases. In the acceleration phases values for the radius are extrapolated or interpolated from compensation line 32 by the linear filter 34, and these values are entered together with the respective signal of the quotient former 33 into the subtraction device 35, which then calculates the slippage S. Furthermore, note that the slippage S is independent of the angular velocity and independent of the diameter, i.e., the slippage is independent of the winding process state.

The control and evaluation unit 25 in FIG. 1 contains the means for evaluation of FIG. 2. The slippage which had been continuously detected during the winding process can be stored, for example, in the control and evaluation device 25 for later call-up, or it can be printed out immediately, so that a user of the winding device can determine with what slippage in the acceleration phases the yarn package had been produced, which provides conclusions regarding the quality of the yarn package including the draw-off properties of the wound yarn. By comparing the slippage values occurring in the course of travel of the yarn package at two or more identical winding devices it is also possible to detect a possible malfunction of one of the winding devices.

The value of the slippage detected parallel with the winding process can also be evaluated in the control and evaluation device 25 in such a way that the slippage is adjusted to a set value by actuation of the drive motor 11. For example, the acceleration can be decreased if it is found that the detected actual value of the slippage exceeds a predetermined set value. Thus it is possible to optimize energy consumption. On the other hand, if the detected actual value of the slippage has not reached the intended set value, the control and evaluation device 25 can furthermore cause the drive motor to be switched on at a higher acceleration and/or the force with which the winding frame presses the yarn package against the friction roller 10 to be reduced.

It has been explained above how the periods of the friction roller 10 and the yarn package detected by the sensors 23,24 are evaluated for determining the value of the slippage parallel with the yarn packages. Because the angular velocity is the reciprocal of the period multiplied by $2\pi$, the explanations of course are also valid for the corresponding detection of the angular velocities rather than the periods. Detection and evaluation of the period should therefore be understood to be analogous to the detection and evaluation of the angular velocity in the present invention.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for determining a value of slippage generated between a friction roller and a yarn package during a winding process at a winding station of a textile winding machine, comprising:

accelerating and decelerating a friction roller that drives a yarn package being wound so that slippage occurs between the friction roller and the entire surface of the yarn package during an acceleration phase and no slippage occurs between the friction roller and part of the surface of the yarn package during a deceleration phase;

detecting a value representative of the angular velocity of the friction roller at least once in said acceleration phase and at least once in said deceleration phase;

detecting a value representative of the angular velocity of the yarn package in said acceleration phase and in said deceleration phase;

estimating a yarn package radius during said acceleration phase from a mathematical progression based upon said values detected in said deceleration phase;

calculating a distorted yarn package radius based upon the fixed radius of the friction roller and based upon said values detected in said acceleration phase; and comparing the estimated yarn package radius with the calculated distorted yarn package radius to determine a value of slippage.

2. A method for determining a value of slippage according to claim 1, wherein said step of comparing the estimated yarn package radius with the calculated distorted yarn package radius comprises dividing the difference between the estimated yarn package radius and the calculated distorted yarn package radius by the calculated distorted yarn package radius.

3. A method for measuring slippage generated between a friction roller and a yarn package being wound at a winding station of a textile winding machine, comprising:

alternately accelerating and decelerating a friction roller that drives a cylindrical yarn package being wound so that slippage occurs between the friction roller and the yarn package in each phase of acceleration and no slippage occurs therebetween in each phase of deceleration;

detecting a period of the friction roller;

detecting a period of the yarn package;

estimating the yarn package radius during an acceleration phase from a mathematical progression of the yarn package radius based upon periods of the friction roller and the yarn package detected during at least one deceleration phase;

calculating a distorted yarn package radius based upon the fixed radius of the friction roller and based upon periods of the friction roller and the yarn package detected during the acceleration phase; and comparing the estimated yarn package radius with the calculated distorted yarn package radius to determine a value of slippage.

4. The method in accordance with claim 3, further comprising the step of recording for later reference the values of slippage that occur in the course of the yarn package winding.

5. The method in accordance with claim 3, further comprising comparing a value of the slippage determined during winding with a set value and changing at least one operating parameter of the winding station if a deviation results between the value of the slippage and the set value.

6. The method in accordance with claims 3, further comprising determining values of slippage during the course of start-up following an interruption of the winding process, comparing the determined values of slippage with set values, and adjusting said acceleration of the friction roller when the values of the slippage exceed the set values in order to limit the slippage values to the set values.

7. A method for measuring slippage generated between a friction roller and a yarn package being wound at a winding station of a textile winding machine, comprising:

alternately accelerating and decelerating a friction roller that drives a conical yarn package being wound so that slippage occurs between the friction roller and the entire surface of the yarn package in each phase of acceleration and no slippage occurs between the friction roller and a driven diameter of the yarn package in each phase of deceleration;

detecting a period of the friction roller;

detecting a period of the yarn package;

estimating the yarn package radius during an acceleration phase from a mathematical progression of the yarn package radius based upon periods of the friction roller and the yarn package detected during at least one deceleration phase;

calculating a distorted yarn package radius based upon the fixed radius of the friction roller and based upon periods of the friction roller and the yarn package detected during the acceleration phase; and comparing the estimated yarn package radius with the calculated distorted yarn package radius to determine a value of slippage.

8. The method in accordance with claim 7, further comprising the step of recording for later reference the values of slippage that occur in the course of the yam package winding.

9. The method in accordance with claim 7, further comprising comparing a value of the slippage determined during winding with a set value and changing at least one operating parameter of the winding station if a deviation results between the value of the slippage and the set value.

10. The method in accordance with claims 7, further comprising determining values of slippage during the course of start-up following an interruption of the winding process, comparing the determined values of slippage with set values, and adjusting said acceleration of the friction roller when the values of the slippage exceed the set values in order to limit the slippage values to the set values.

11. A winding station of a textile winding machine for producing yarn packages, comprising:

a friction roller for controlling the winding of yarn onto a yarn package and a drive motor for controlling acceleration of the friction roller resulting in slippage between the friction roller and the entire surface of a yarn package and for controlling deceleration of the friction roller resulting in no slippage between the friction roller and at least part of the surface of the yarn package;

a first sensor that detects a period of the yarn package;

a second sensor that detects a period of the friction roller; and a control and evaluation device in communication with said sensors including:

a quotient former that calculates a ratio between the angular velocities of said friction roller and a yarn package based upon detected periods of a yarn package and said friction roller, a linear filter that evaluates a progression of the yarn package radius in at least one deceleration phase for estimating the yarn package radius in an acceleration phase based upon the calculated ratio and the detected angular velocities in the deceleration phase, and a subtraction device for comparing the estimated yarn package radius in the acceleration phase with the calculated yarn package radius in the acceleration phase to determine a value of slippage.

* * * * *